United States Patent [19]

Tanino

[11] Patent Number: 5,018,604

[45] Date of Patent: May 28, 1991

[54] APPARATUS FOR TRANSMITTING SIGNAL FOR GROUP SUPERVISION OF ELEVATORS

[75] Inventor: Junichi Tanino, Inazawa, Japan

[73] Assignee: Mitsubishi Denki Kabushiki Kaisha, Japan

[21] Appl. No.: 388,518

[22] Filed: Aug. 2, 1989

[30] Foreign Application Priority Data

Aug. 5, 1988 [JP] Japan ..... 63-195650

[51] Int. Cl.[5] ..... B66B 3/00

[52] U.S. Cl. ..... 187/121; 187/124

[58] Field of Search ..... 187/121, 124, 127

[56] References Cited

U.S. PATENT DOCUMENTS 4,765,442 8/1988 Blain et al. ..... 187/124

4,872,532 10/1989 Tobita et al. ..... 187/121

*Primary Examiner*—A. D. Pellinen

*Assistant Examiner*—Charles E. Eckholdt

*Attorney, Agent, or Firm*—Leydig, Voit & Mayer

[57] ABSTRACT

An apparatus for transmitting signals for group supervision of elevators having a group supervising device which receives hall calling signals for and assigns the hall callings to different cages, a plurality of controllers in a machine room connected by signal lines to the group supervising device, signal transmitter/receivers provided in the controllers, and connected in series through signal lines for transmitting and receiving signals through the signal lines, call buttons connected to signal transmitters/receivers on respective floors for generating the hall calling signals, and calling signal transmitters provided in the controllers for transmitting the hall calling signal to the supervising device.

3 Claims, 7 Drawing Sheets

APPARATUS FOR TRANSMITTING SIGNAL FOR GROUP SUPERVISION OF ELEVATORS

BACKGROUND OF THE INVENTION

The present invention relates to an apparatus for transmitting and receiving a signal for a group supervision of elevators in a serial transmission system.

FIG. 9 is view of an overall arrangement showing a prior-art apparatus for transmitting a signal for a group supervisory elevator.

In the drawings, reference numeral 1 denotes a group supervising device installed in a machine room for calculating to assign a cage, numerals 2 and 3 denote controllers installed similarly in the machine room and connected to the group supervising device via signal lines 4 and 5 for controlling first and second elevators, numeral 6 and 7 denote signal lines wired from the controllers 2 and 3 on each floor, numeral 8 denotes a signal line wired from the group supervising device 1 on each of the floors, numeral 9 and 10 denote halls for the first and second elevators of a certain floor, and numeral 11 denotes a floor display panel connected to the signal line 6 provided on the hall 9 for the first elevator and having a signal transmitter/receiver (to be described later), a position display lamp and an elevating direction lamp made of up and down lamps. Numeral 12 denotes a floor display panel similar to the floor display panel 11, provided on the hall 10 for the second elevator and connected to the signal line 7, numeral 13 denotes a hall button provided commonly for the first and second elevators and connected to the signal line 8 and having up and down buttons and up and down call registration lamps.

The prior-art apparatus for transmitting a signal for a group supervision of elevator is composed as described above, and signals are transmitted and received through the signal lines 4 to 8 among the signal transmitters/-receivers of the group supervising device 1, the controllers 2 and 3, and the floor display panels 11 and 12 in a serial signal transmission system as will be described later.

More specifically, when the hall button 13 is operated, a hall calling signal is generated, and transmitted through the signal line 8 to the group supervising device 1. The group supervising device 1 registers the hall calling signal, transmits a hall calling registration signal through the signal line 8, and lights, for example, an up calling registration lamp of the hall button 13. Then, the group supervising device 1 selects the position of the cage (not shown) of each elevator and a cage to be presumed to arrive at the halls 9 and 10 from the elevating direction or the like in a shortest time, and assigns the cage for the hall calling. If it is the first elevator cage, it instructs the operation of the cage to the controller 2 through the signal line 4. Then, the controller 2 transmits a firing signal of the elevating direction lamp, such as an up lamp lighting signal through the signal line 6, inputs the signal to the floor display panel 11, and lights the up lamp through the signal transmitter/receiver. Further, a cage position signal representing the position of the cage is also transmitted, and the position display lamp is displayed (12-th floor in the drawing) through the signal transmitter/receiver.

In the prior-art signal transmitter/receiver for group supervision of elevators described above, the signal line 8 wired from the group supervising device 1 to the hall button 13 and the signal lines 6 and 7 wired from the controllers 2 and 3 to the floor display panels 11 and 12 are wired on the respective floors. Accordingly, if the number of the cages to be installed is increased and the number of the hall buttons 13 on the first floor is increased, there arises a problem that the number of the signal lines 8 is increased. Further, if the group supervising device 1 or the signal line 8 has a defect, all of the cages of the elevators cannot respond to the hall callings, and there arises a serious trouble that the elevators are not operated for the specific or all the hall callings.

SUMMARY OF THE INVENTION

The present invention has been made to eliminate the above-described problems and has for its object to provide an apparatus for transmitting a signal for a group supervision of elevator in which, even if the number of hall buttons to be installed on a first floor is increased, the number of signal lines from a group supervising device to hall buttons is not increased, and, even if the signal line has a defect, the state that all the cages cannot respond can be avoided, thereby improving the reliability of the operation.

An apparatus for transmitting a signal for a group supervision of elevator according to the present invention connects hall buttons to signal transmitters/receivers in the respective floors and provides calling signal transmitting means for transmitting the hall calling signals of the controllers to the group supervising device.

In the present invention, the hall calling signal of the respective floors are transmitted to the controllers commonly by way of signal lines from the controllers to a plurality of signal transmitters/receivers of the respective floors to transmit the signal from the controllers to the group supervising device. Therefore, the hall calling signals are transmitted from the plurality of signal transmitters/receivers through the signal lines, and signal lines wired from the hall buttons to the group supervising device are not provided.

BRIEF DESCRIPTION OF THE DRAWINGS

FIG. 1 is a view of an overall arrangement of the apparatus;

FIG. 2 is a block diagram of a group supervising device;

FIG. 3 is a block diagram of a controller

FIG. 4 is a block diagram of a signal transmitter/-receiver;

FIGS. 5 and 6 are flowcharts showing the hall calling signal transmitting operations of the controller and the group supervising device;

FIG. 7 is a view of the content of the signal;

FIG. 8 is an explanatory view of the transmission; and

In the drawings, the same symbols indicate identical or corresponding portions.

DESCRIPTION OF THE PREFERRED EMBODIMENTS

Figure 1:
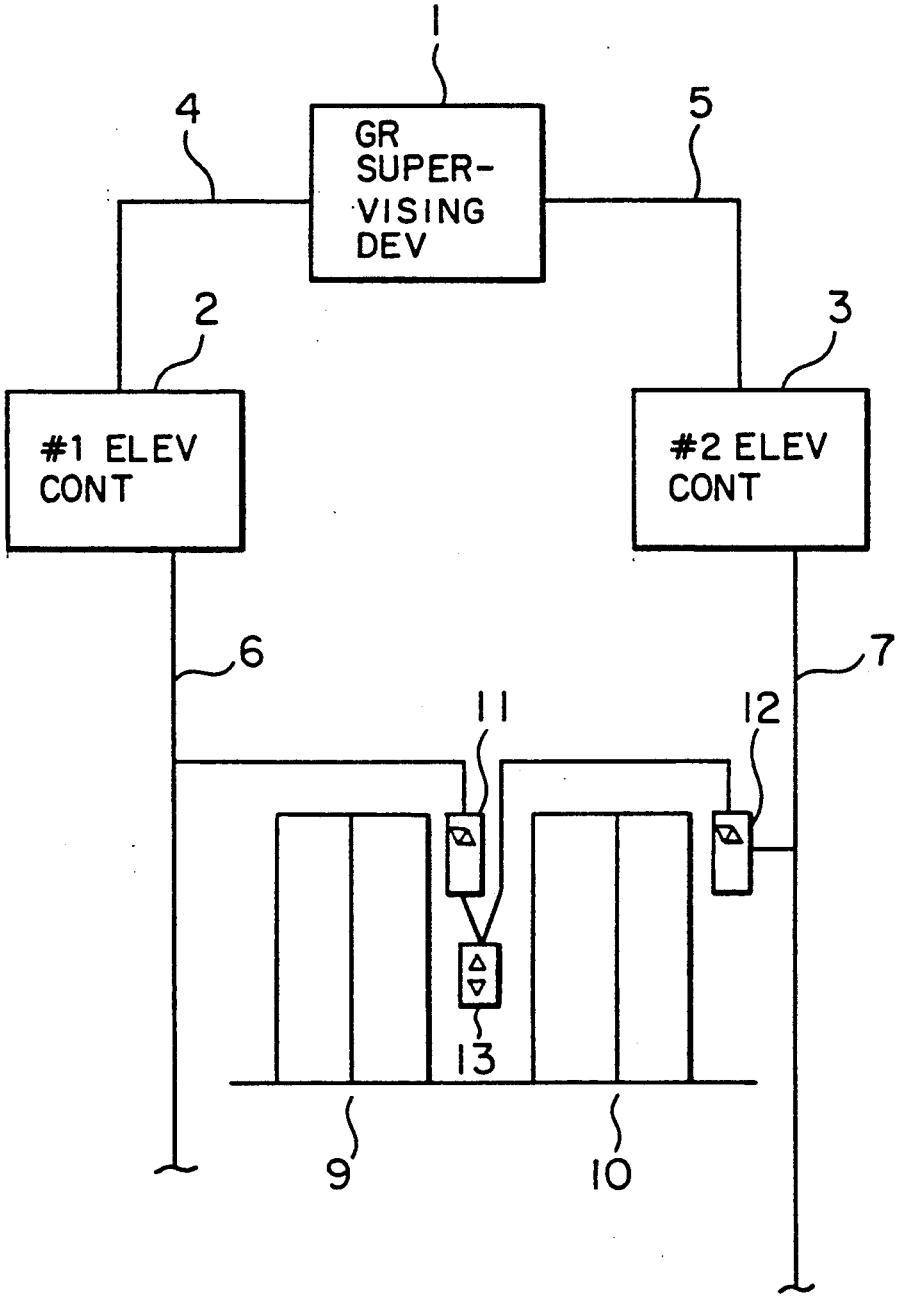
FIGS. 1 to 8 are views showing an embodiment of an apparatus for transmitting a signal for a group supervision of elevators according to the present invention.
Figure 2:
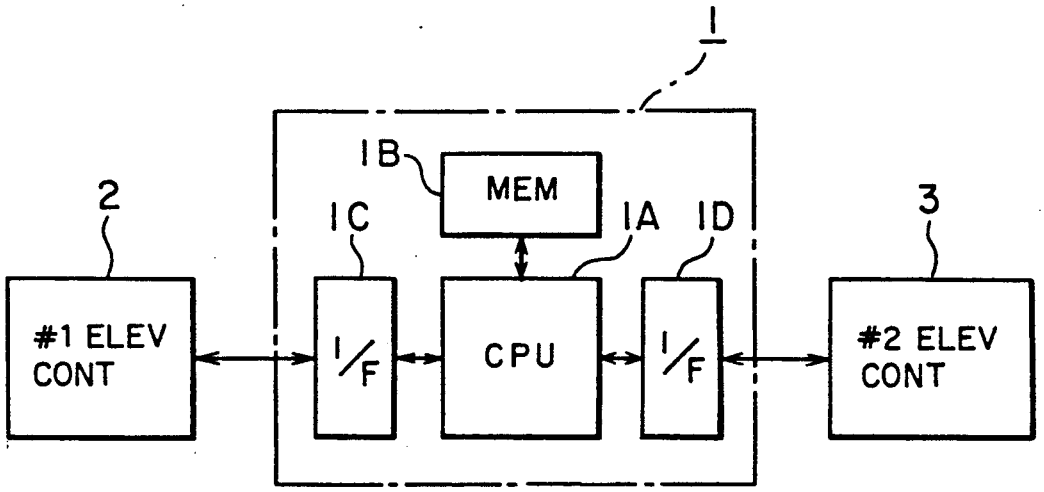
Figure 3:
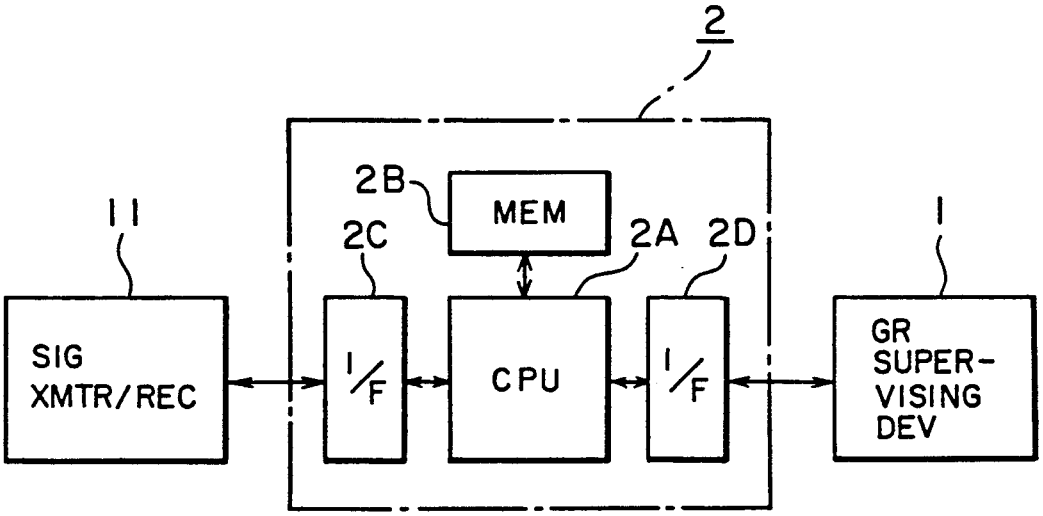

FIGS. 1 to 8 are views showing an embodiment of the present invention. FIG. 1 is a view of the entire arrangement, FIG. 2 is a block diagram of a group supervising device, FIG. 3 is a block diagram of a controller, FIG.

Figure 5:
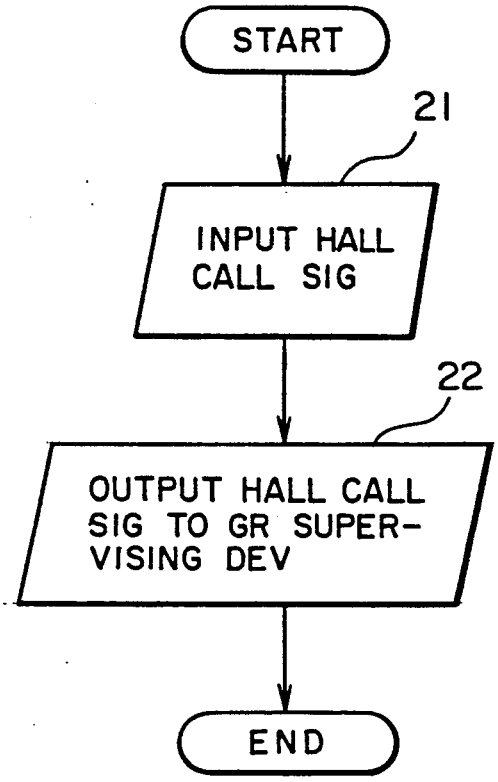
Figure 6:
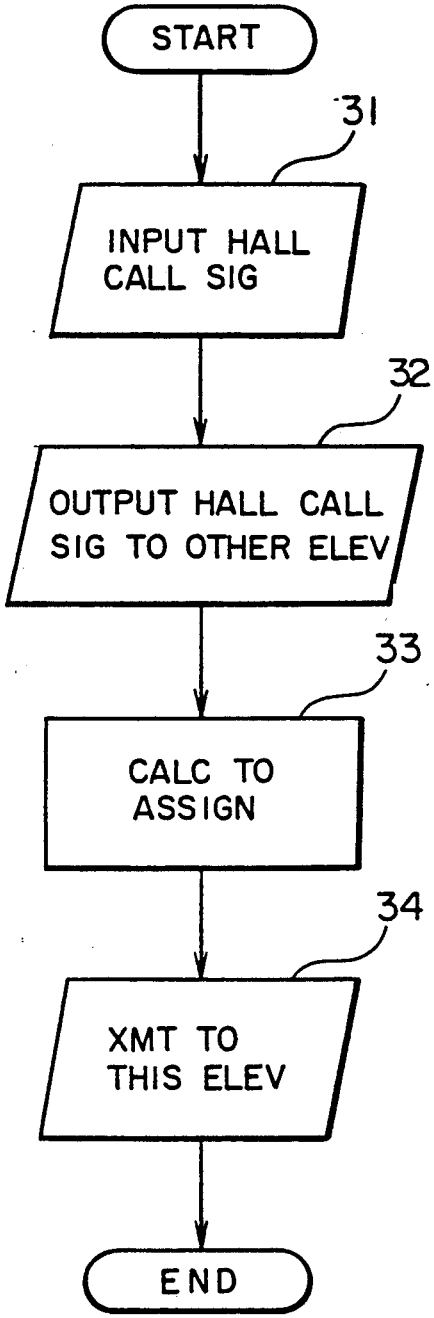
Figure 7:
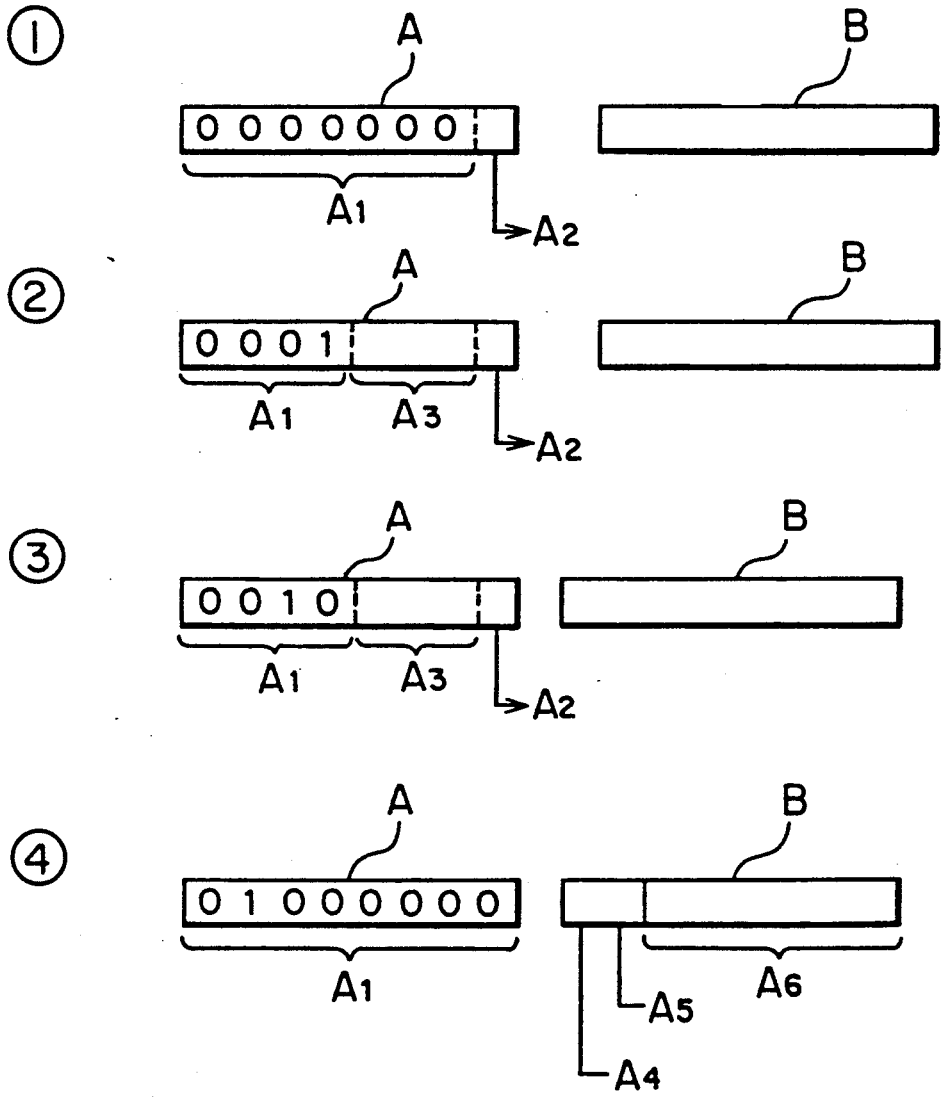
Figure 8:
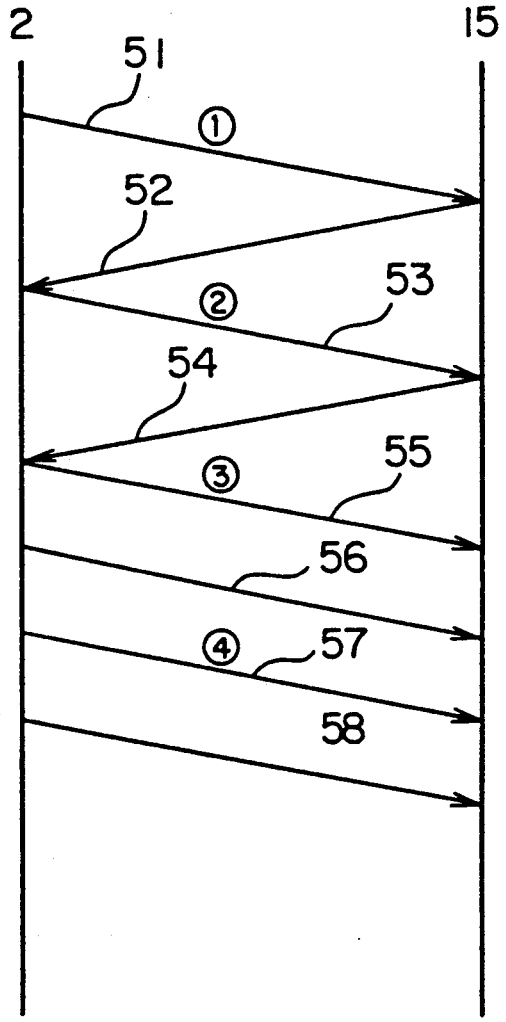

4 is a block diagram of a signal transmitter/receiver, FIG. 5 is a flowchart showing the hall calling signal transmitting operation of the controller, FIG. 6 is a flowchart showing the operation of the group supervising device, FIG. 7 is a view of the contents of the signal, and FIG. 8 is a view for explaining the transmission, wherein the same symbols as those in the prior art denote identical or corresponding portions.

Figure 9:
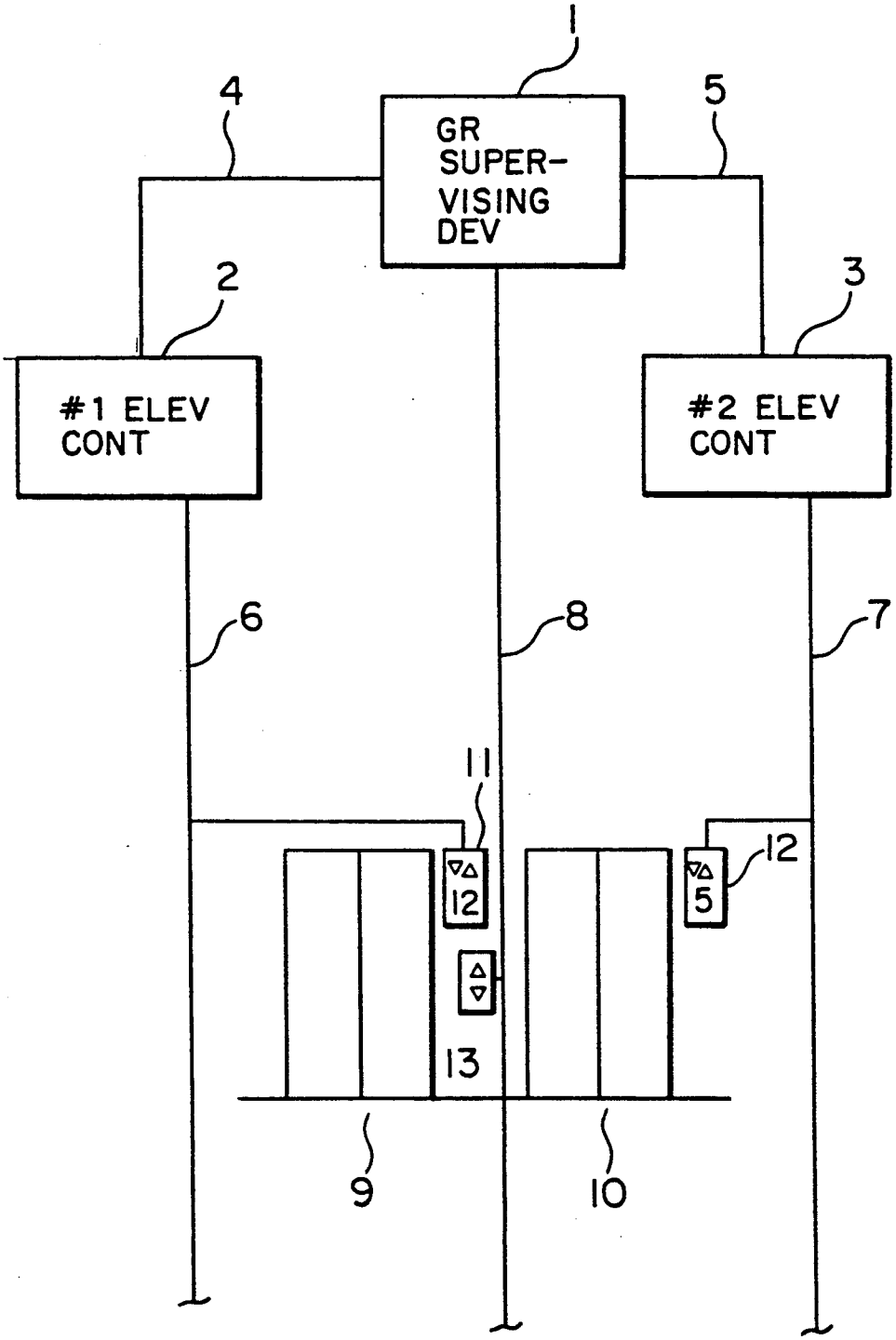
FIG. 9 PRIOR ART
FIG. 9 is a view of an overall arrangement showing a prior-art apparatus for transmitting a signal for group supervision of elevators.

In this embodiment, as apparent from FIG. 1, in accordance with the invention, hall button 13, floor display panels 11 and 12 for first and second elevator cages, elevator controllers 2 and 3 and group supervising device 1 are connected in a series connection. The signal lines 8 wired from the group supervising device 1 to the hall buttons 13 of the respective floors as shown in FIG. 9 are not required, thereby eliminating the need for such signal lines 8 of the prior art systems.

In FIGS. 2 and 3, reference numeral 1 denotes a group supervising device formed of a microcomputer, which has a CPU 1A, a memory 1B and input/output interface (hereinafter referred to as "I/F") 1C and 1D. The I/F 1C is connected to a controller 2 for a first elevator cage, and the I/F 1D is connected to a controller 3 for a second elevator cage. The controller 2 is the controller (similar in the controller 3) composed of the microcomputer, which has a CPU 2A, a memory 2B and I/F 2C and 2D. The I/F 2C is connected to the floor display panel 11, and the I/F 2D is connected to the group supervising device 1.

Figure 4:
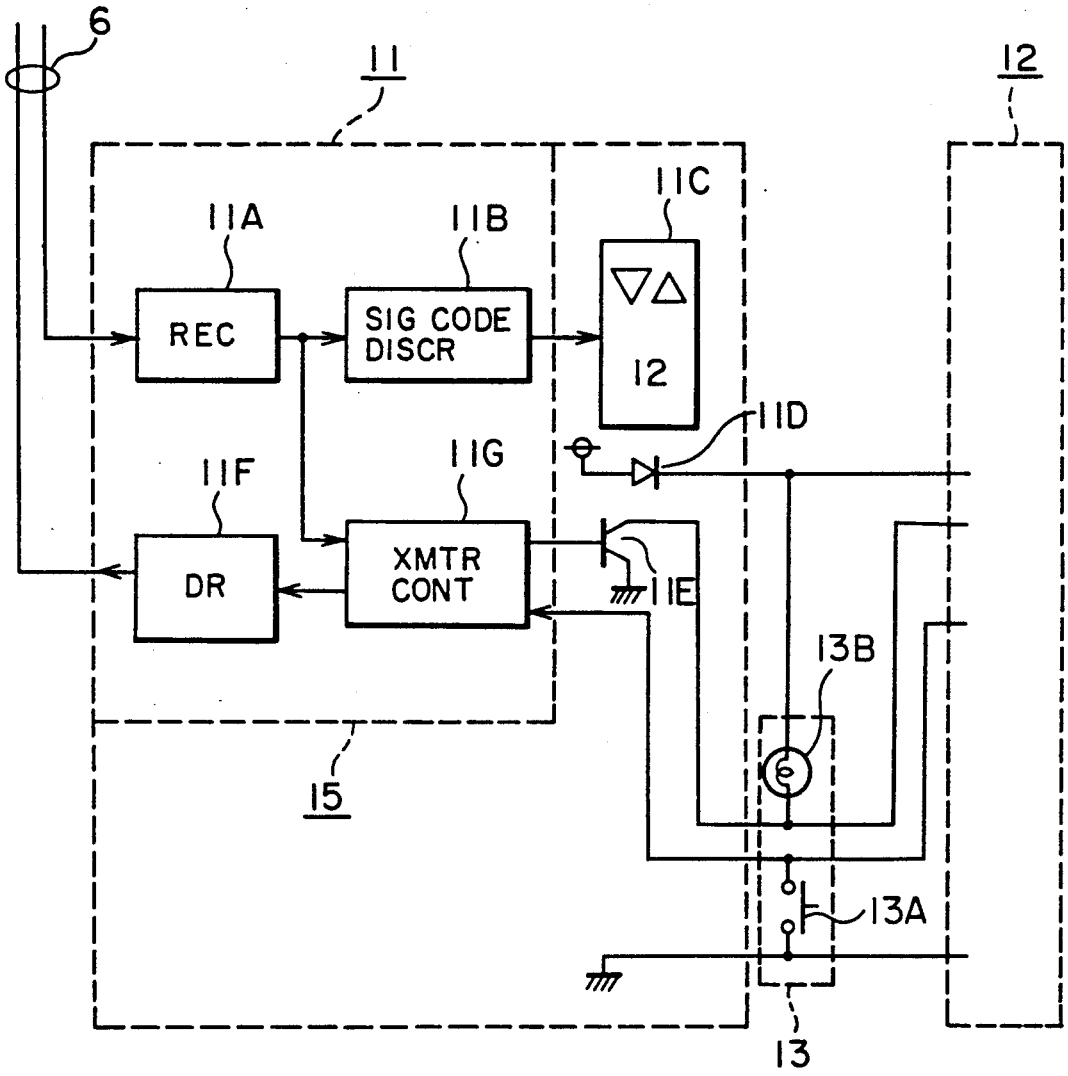

In FIG. 4, numeral 11 denotes a floor display panel, symbol 11A denotes a receiver connected to a signal line 6, symbol 11B denotes a signal code discriminator connected to the receiver 11A for discriminating the command data of an inputted serial transmission signal to output only ON/OFF signal of an elevating direction lamp and a cage position signal, symbol 11C denotes a hall indicator associated with an elevating direction lamp made of up and down lamps and a position display lamp, symbol 11D denotes a diode, symbol 11E denotes a transistor, symbol 11F denotes a driver connected to the signal line 6, symbol 11G denotes a transmission controller connected to the receiver 11A, the driver 11F, the transistor 11E and the calling button 13A of the hall button 13 for discriminating a command regarding the hall button 13 of this floor of the command/data inputted from the receiver 11A to transmit a signal to the transistor 11E if the discriminated data relates to the hall registration lamp 13B of the hall button 13 and to output the hall calling signal to the driver 11F if it is the fetch command of the calling button 13A. The signal code discriminator 11B and the transmission controller 11G are composed of microcomputers to compose signal transmitter/receiver 15 together with the receiver 11A and the driver 11F. The floor display panel 12 is similarly composed.

The operation of the embodiment described above will be described.

When the calling button 13A of the hall button 13 is operated, the hall calling signal is transmitted as a serial signal from the transmission controller 11G of the signal transmitter/receiver 15 by way of the driver 11F to the signal line 6. Similarly, the signal is also transmitted from the signal transmitter/receiver (not shown) of the floor display panel 12 to the signal line 7.

The controllers 2 and 3 input the hall calling signals to a group supervision device 1 in step 31, and output hall calling signals to the controllers 3 and 2 of opponent elevator cages in a step 32. On the other hand, the group supervision device 1 calculates to assign the hall callings to the cages by a known procedure in a step 33. As a result, if the first elevator cage is assigned for the hall calling, they generates a command to the controller 2 in a step 34, and the first elevator cage starts elevating in response to the hall callings.

On the other hand, a signal as shown in FIG. 7 is communicated from the controller 2 to the signal transmitter/receiver 15 through the signal line 6 in a time series train as shown in FIG. 8 (the signal is also communicated from the controller 2 to the the signal transmitter/receiver of the floor display panel 12).

Commands (1) to (4) in FIG. 7 each has a first byte A and a second byte B, and each of the bytes A and B has 8 bits.

(1) denotes a first command, the first byte A is data for detecting whether or not the hall button 13 of each zone (which is divided from the total number of the hall buttons 13, one zone including 8 hall buttons) is depressed, including a 7-bit command $A_1$ and 1-bit direction data $A_2$ representing up or down button. The second byte B is data which becomes "0" if there is a floor where its hall button 13 is depressed in the zone, dividing into "0" and "1-7 bits".

(2) denotes a second command, a 4-bit command $A_1$, a 3-bit zone data $A_3$ and a 1-bit direction data $A_3$ for receiving data representing where the hall call generated in each zone is disposed in the zone. The second byte B is input data.

(3) denotes an output command that the hall button 13 is depressed. A first byte A includes a 4-bit command $A_1$, a 3-bit zone data $A_3$ and 1-bit direction data $A_2$. The second byte B is data representing whether 8 hall calling registration lamps in the zone are ON ("0") or OFF ("1").

(4) denotes an output command for each hall position display lamp, the first byte A includes a 8-bit command $A_2$. The second byte B has a 2-bit up lamp data $A_4$ and down lamp data $A_5$, and 6-bit cage position data $A_6$.

The commands as described above are assigned to transmit and receive 8 zone x 8, i.e., 64 floor data. The zones are divided such that first to 8-th floors are assigned to a 0-th zone, 9-th to 16-th floors are assigned to a first zone, 17-th to 24-th floors are assigned to a second zone, 25-th to 32-th floors are assigned to a third zone, 33-th to 40-th floors are assigned to a fourth zone, 41-st to 48-th floors are assigned to a fifth zone, 49-th to 54-th floors are assigned to a sixth zone, and 55-th to 64-th floors are assigned to a seventh zone.

Then, the signal transmitting operation of this embodiment will be described with reference to FIG. 8. Here, steps 51 and 53 denote instructing means, steps 52 and 54 denote responding means, and steps 55 to 60 denote output means.

First, the first command (1) is outputted to input data of the hall button 13 from the controller 2 in the step 51. The signal transmitter/receiver 15 which receives the first command (1) sets the signal in this zone to "0" in accordance with the floor data set in the step 51 if the hall button 13 is depressed. For example, if the up button on the tenth floor is depressed, only the first zone, i.e., the first bit of the second byte B becomes "0". If the buttons are simultaneously depressed on the fifth and tenth floors, the 0-th zone and the first zone, i.e., the 0-th bit and the first bit of the second byte B become "0". The controller 2 which receives the data which becomes "0" in the zone data $A_3$ of the second command (2) in the step 53 to "0010" (the third bit from the left indicates the first zone, and the right end bit indicates the up button), if the up button on the tenth floor is depressed, and output it as the second command (2). The signal transmitter/receiver 15 which receive the signal only in the ninth to sixteenth floors operate, and output the 0-th bit (ninth floor) of the input data B being "0", the second bit (tenth floor) being "0", the third bit (eleventh floor) being "1", . . . , seventh bit (sixteenth floor) being "1" in the step 54. If the hall buttons 13 in two or more zones are depressed, the first command (1) of the step 51 is sequentially outputted to obtain the hall button data of each floor. The controller 2 distinguishes the zone and up or down button similarly to the second command (2), and outputs them in the step 55. Further, it carries the lamp data of the hall calling registration lamp on the second byte B, and outputs it. In other words, the first byte A of the command for firing the tenth floor up registration lamp is "00100010", and the second byte B is "10111111".

The signal transmitter/receiver 15 which receives the output command (3) fires the tenth up registration lamp, resets the tenth up button signal, and stop transmitting the up button signal to the controller 2 again at the time of scanning. This stop is released when the OFF command is received.

The output command (4) is the ON/OFF command of the position display lamp, the first byte A is transmitted in the step 57, and the second byte B is transmitted in the step 58. In this case, since the displays in all the floors are the same, the first byte A is "01000000", and up or down lamp data $A_4$, $A_5$ and cage position data $A_6$ (binary signal) are outputted to the second byte B.

As described above, since the signal transmission line from the hall button 13 to the group supervising device 1 has a double systems of the signal lines 6 to 4 and 7 to 5, even if one of the transmission lines, such as the signal lines 6 to 4 has a defect, the hall calling signal can be transmitted by way of the other signal lines 7 to 5. Thus, at least one cage can be operated, thereby improving the reliability of the operation. Further, even if the group supervising device 1, the signal line 4 or 5 has a defect, the signal lines 6 and 7 between the controllers 2, 3 and the floor display panels 11, 12 are established. Therefore, in this case, it becomes the same as the signal transmission network of one cage. In other words, wasteful response of responding to one hall calling by two cages is generated, but they function as independent operation type of one cage, and the state that there is no cage at all can be avoided. Further, the controllers 2, 3 have an advantage that they can be operated merely by adding the signal lines 4 and 5 to the group supervising device 1 to the hall wirings in case of independent cage operation type. Moreover, the group supervising device 1 can eliminate the I/F (not shown) to the prior-art hall button 13, thereby reducing its cost.

In addition, since the signal transmitters/receivers 15 on the respective floors are associated in the floor display panels 11 and 12 individually provided in the elevator cages, the hall buttons 13 are solely connected to a plurality of the cages. Therefore, the units can be commonly utilized in case of the independent cage operation type.

In the embodiment described above, the elevating direction and position display lamps are provided on the floor display panels 11 and 12. However, the present invention is not limited to the particular embodiment. For example, they are not provided on the floor display panes, but only an arrival prenotice lamp may be provided. In this case, the ON/OFF of the elevating direction and the position display lamps can be replaced with those of the arrival prenotice lamp.

In the embodiment described above, the hall buttons 13 are connected to both the floor display panels 11 and 12. However, the present invention is not limited to the particular embodiment. For example, the hall buttons 13 may be provided at the respective elevator cages, and connected to the floor display panels 11 and 12.

According to the present invention as described above, the hall buttons are connected between the signal transmitter/receivers of the respective floors and calling signal transmitting means for transmitting the hall calling signals to the group supervising device are provided in the respective controllers. Therefore, the signal lines from the group supervising device to the hall buttons can be eliminated, and even if a defect occurs in the signal line, the state that all the cages cannot respond at all can be avoided, thereby improving the reliability of the operation of the elevators.

What is claimed is:

1. An apparatus for transmitting signals for group supervision of elevators comprising:

(a) a group supervising device;

(b) a plurality of elevator controllers which generate and transmit control signals;

(c) floor display panels on each floor which display elevator location represented by display signals;

(d) hall buttons on each floor which transmit hall calling signals; and (e) control signal discriminating and calling signal transmitting means associated with a floor display panel and hall button on each floor for discriminating display signals from control and transmitting hall calling signals to said group supervising device;

(f) said elevator controller, said floor display panels, said hall buttons, said signal transmitting and discriminating means being connected in a series connection with said group supervising device, and the control signals and hall calling signals being serially transmitted through the series connection.

2. An apparatus for transmitting signals for group supervision of elevators according to claim 1, wherein each elevator has a corresponding elevator controller.

3. An apparatus for transmitting signals for group supervision of elevators according to claim 1, wherein said floor display panel includes a signal code discriminator and a transmission controller which discriminates the command data of an inputted serial transmission signal.

* * * * *